US005356323A

United States Patent [19]

Evans

[11] Patent Number: 5,356,323

[45] Date of Patent: Oct. 18, 1994

[54] CLOSED SHOE SWIM FIN

[76] Inventor: Robert B. Evans, 28 Anacapa St., Santa Barbara, Calif. 93101

[21] Appl. No.: 64,139

[22] PCT Filed: Dec. 31, 1990

[86] PCT No.: PCT/US90/07539

§ 371 Date: May 21, 1993

§ 102(e) Date: May 21, 1993

[87] PCT Pub. No.: WO92/11906

PCT Pub. Date: Jul. 23, 1992

[51] Int. Cl.[5] ..... A63B 31/08

[52] U.S. Cl. ..... 441/64

[58] Field of Search ..... 441/64, 61; D21/239

[56] References Cited

U.S. PATENT DOCUMENTS

| | | | |
|---|---|---|---|
| 1,607,857 | 11/1926 | Zukal . | |
| 2,073,570 | 3/1937 | Sutherland | 9/21 |
| 2,423,571 | 7/1947 | Wilen | 441/64 |
| 2,737,668 | 3/1956 | Cressi et al. | 9/21 |
| 3,019,458 | 2/1962 | De Barbieri et al. | 9/309 |
| 3,055,025 | 9/1962 | Ferraro et al. | 441/64 |
| 3,112,503 | 12/1963 | Girden | 9/309 |
| 3,239,857 | 3/1966 | Gwynne | 9/309 |
| 3,422,470 | 1/1969 | Mares | 9/309 |
| 4,007,506 | 2/1977 | Rasmussen | 9/309 |
| 4,541,810 | 9/1985 | Wenzel | 441/64 |
| 4,738,645 | 4/1988 | Garofalo | 441/64 |
| 4,752,259 | 6/1988 | Tackett et al. | 441/64 |
| 4,857,024 | 8/1989 | Evans | 441/64 |
| 4,929,206 | 5/1990 | Evans | 441/64 |

FOREIGN PATENT DOCUMENTS

| | | | |
|---|---|---|---|
| 1245395 | 9/1960 | France | 441/64 |
| 1322734 | 2/1963 | France | 441/64 |

*Primary Examiner*—Stephen P. Avila

*Attorney, Agent, or Firm*—Cislo & Thomas

[57] ABSTRACT

A closed shoe swim fin which has a planar trapezoidal shaped flexible base (20) with a pair of symmetrical upwardly curved tips (26). An enlarged bulbous foot retainer (32) is integrally located on the base at the rear portion. The retainer has a rearward opening (34) and an inside cavity (36) larger than the size of the foot of a swimmer allowing flexing of the users foot. A strap (42) with a stiffening sleeve (46) and buckle (48) hold the foot into the swim fin. The base is planar in the middle and tapers toward the outside edge. The tips are flexible enough that they are responsive to a force urged against the upper surface, causing an arcuate shaped path curling away from the foot retainer creating a build-up of water pressure within the flexed surface, subsequently when the direction of travel is reversed a snapping action takes place producing a propelling force through the water.

8 Claims, 3 Drawing Sheets

CLOSED SHOE SWIM FIN

TECHNICAL FIELD

The present invention relates to swim fins which are attached to swimmer's feet to improve the swimmer's ability of propulsion through the water, in general. More specifically, to a fin that is worn by a swimmer like an open heel shoe and utilizes a snapping action of the tips.

BACKGROUND ART

Previously, many types of swim fins have been used to provide an effective means to assist a person in propelling themselves through the water. A single fin has been the generally accepted method with some type of foot retaining device including, straps, shoes enclosing pockets, contoured openings, etc. Little attention has been given to the flexible action of the fin other than its direct resistance to the water or how they considered the ability of the swimmer's foot to flex within the foot retainer.

A search of the prior art did not disclose any patents that read directly on the claims of the instant invention, however, the following U.S. patents were considered related:

| U.S. Pat. No. | Inventor | Issue Date |
|---|---|---|
| 1,607,857 | Zukal | Nov. 23, 1926 |
| 2,073,570 | Sutherland | Mar. 09, 1937 |
| 2,737,668 | Cressi et al | Mar. 13, 1956 |
| 3,019,458 | De Barbieri et al | Feb. 06, 1962 |
| 3,112,503 | Girden | Dec. 03, 1963 |
| 3,239,857 | Gwynne | Mar. 15, 1966 |
| 3,422,470 | Mares | Jan. 02, 1969 |
| 4,007,506 | Rasmussen | Feb. 15, 1977 |
| 4,541,810 | Wenzel | Sep. 17, 1985 |
| 4,738,645 | Garofalo | Apr. 19, 1988 |
| 4,752,259 | Tackett et al | Jun. 21, 1988 |
| 4,857,024 | Evans | Aug. 15, 1989 |

Zukal, in U.S. Pat. No. 1,607,857, discloses a swimming device intended to be attached to the foot of the swimmer. Although not referred very clearly in the text, part of the device appears to be a shoe-like portion, shown in FIGS. 1, 3 and 4. Apart from disclosing a shoe-like portion, however, this reference is nothing like the disclosed invention.

U.S. Pat. No. 2,073,570 issued to Sutherland discloses a "swimming shoe" provided with wing members 17 attached to the shoe top 15. This prior art does disclose the feature of the ability of the swimmer to flex his foot inside the device, inasmuch as the shoe part of the device appears to be of fairly conventional design, and street shoes normally allow flexing of the feet of the wearer.

Cressi et al, in U.S. Pat. No. 2,737,668, directs their attention to a fin for a swimmer. The fin comprises a housing 3 for the foot having an opening 4 through which the toes of the swimmer project, and upturned side portions 5 having rounded edges 6, 7. As shown in FIG. 2, the housing 4 has a heel section for enclosing the foot of the swimmer and a slight bulbous region. However, the height of housing 4 is not sufficient to allow the swimmer's foot to flex within the shoe portion.

De Barbieri et al disclose in FIGS. 1, 2 and 4 of U.S. Pat. No. 3,019,458 a swim-fin having a shoe portion 1 from which integral heel and toe sections a and b extend upwardly. The shoe portion appears to be open at the toes.

U.S. Pat. No. 3,112,503 issued to Girden, as illustrated in FIGS. 2, 3 and 6, discloses a swim-fin employing a buoyant material to overcome the negative buoyancy of the legs and feet of a swimmer. A hollow foot pocket 14 having a convex curvature extends from a sole portion 12 and is provided with an orifice 15 at the forward end.

Gwynne is directed to a swim fin in U.S. Pat. No. 3,239,857 that comprises a shoe 10 having a flat platform piece 11 and a vamp forming a socket 12 for containing the forepart of the swimmer's foot. Also, a fin blade 16, a heel portion 13, and a leg-encasing member 20 that engages the lower part of the swimmer's leg. There is, however, an opening between the heel portion 13 and the leg-encasing member 20.

U.S. Pat. No. 3,422,470 of Mares teaches a swimming-fin comprising a shoe section 1 and a webb 2 extending forwardly from the toe end of shoe section 1. As illustrated in FIGS. 1 and 2, shoe section 1 is closed at the toe but it is not disclosed in the text whether there is sufficient room in the front part of shoe section 1 for the swimmer to flex his foot.

Rasmussen, in U.S. Pat. No. 4,007,506, is directed to a swim-fin having a foot portion 12 and a blade portion 14. The foot portion 12 includes two side walls 16 and 17, a heel 18, a sole 19, and an upper wall 20 which together define an opening 22 into which the swimmer inserts his foot. There is no disclosure in this prior art of how much room there is inside the foot portion to flex the swimmer's foot.

U.S. Pat. No. 4,541,810, issue to Wenzel, employs a swimming flipper that is adapted to receive both feet, ankles, and to some extent, the lower part of the swimmer's legs. The specification makes clear that the feet 13 of the swimmer or user are meant to be received "snugly" within foot-receiving pocket 14.

Garofalo discloses in U.S. Pat. No. 4,738,645 a swim fin which directs the fluid flow produced during swimming in the active propulsion direction. Referring to FIGS. 8, 11 and 12, the fin comprises a shoe portion 101, a blade portion 201, and two side ribs 301 for stiffening the blade 201. The fin has an enlarged bulbous area at the front end of the shoe portion 101. However, the shoe portion 101 is not enclosed.

U.S. Pat. No. 4,752,259 issued to Tackett et al is directed to swin fins generally. Referring to FIG. 2, the swim fin 10 comprises a rubber shoe section section 12, a fin portion 14 having an outer section 16 and an inner section 18, rotating hinges 20 to connect the outer section 16 and the inner section 18, and a catch 22 to lock the hinges 20 for the purpose of keeping the outer and inner portions either in extended or folded positions relative to each other. As shown in FIG. 2, the forward area of shoe section 12 is somewhat bulbous, in configuration.

Of considerable relevance is U.S. Pat. No. 4,857,024 issued in Aug. 15, 1989 to the inventor. While this patent is for a single fin, with an open toe section, much of the same action of the fin is incorporated into this invention in combination. Other elements are different enough as to make the combination distinguish over the inventors own prior art.

It will be noted that while all of the above prior art cited has some method of foot retension, none disclose a bulbous shoe portion that would allow the foot of the swimmer to flex within the shoe and certainly not the combination of the flex action with the flexing movement of the fin itself creating a flipping or snapping action to propel the swimmer.

DISCLOSURE OF THE INVENTION

It will be noted that the prior invention of the present inventor described in U.S. Pat. No. 4,857,024 operates in a manner which is substantially opposite to that of the prior art devices described previously. Specifically, during the portion of a stroke which would be considered the power stroke by the prior art swim fins, that portion of the stroke would be considered the reset stroke. Conversely, what traditionally is the reset stroke for the prior art swim fins is the power stroke for the present fin such that the swim fin of the present invention produces a propelling force during the portion of a swimmer's stroke when a swimmer's leg is moved from a position substantially parallel with that of the swimmer's body into a position where the foot is located below the swimmer's body.

It was found that by altering the entire approach to the improvement of swim fins, including the use of a bulbous foot retainer instead of a shoe like foot portion the novelty of the snapping action of the prior invention could be combined with the use of a foot retainer allowing a flex action therewithin new and unexpected results were achieved. Without this combination, no substantial improvement could be made to the swim fin by simply adding a shoe with a bulbous configuration to the conventional swim fin now in common use. It is, therefore, the primary object of the invention to employ a swim fin for a swimmer with a foot retainer so configured as to allow the swimmer's foot to flex within, up and down along with a flexible fin having sufficient resiliency and a cross-sectional area to allow a power stroke to be employed in conjunction with the snapping action of the tip of the fin.

Another object of the invention is directed to the structure of the foot retainer itself and its ability to react to the human foot. Normally a shoe portion of a swim fin fits the foot tight enough to hold the foot in a rigid position intimate with both the top and bottom, as well as the sides. The muscles within the foot and toes of the swimmer are not utilized at all when so confined in the fin and are immobilized by the structure itself. This restriction and limitation of movement is overcome by the invention which employs an enlarged bulbous foot container much like a shoe, except the cavity fits the foot near the opening only and flares outwardly slightly on the sides, however, is formed on the upper inside surface in the same configuration as a swimmer's foot, except large enough to allow flexing within. Since the area is large enough the muscles are now allowed to move the foot and toes providing additional strength to assist the legs in the kick and flip movement of the fin. This arrangement, therefore, provides the swimmer with greater efficiency in muscle utilization and hence, easier and faster propulsion through the water.

Yet, another object of the invention is that the swim fin may be utilized without the necessity of a strap, or, if a strap is broken or becomes disconnected, the swim fin will remain on a swimmer's foot due to the direction of the force vectors urging the fin thereagainst during the power stroke.

Further, the swim fin has its foot receiving portion and its flexible fin portion formed of a resilient material which is molded into an integral one-piece molding of the resilient material.

These and other objects and advantages of the present invention will become apparent from the subsequent detailed description of the preferred embodiment and the appended claims taken in conjunction with the accompanying drawings.

BEST MODE FOR CARRYING OUT THE INVENTION

The best mode for carrying out the invention is presented in terms of a preferred embodiment.

In order to describe the complete relationship of the invention, it is essential that some description be given to the manner and practice of functional utility and description of the fins action relative to the water and the movement of the swimmer. In using the fins of the present invention, a swimmer will normally utilize his legs to develop a kick stroke. In developing a kick stroke, each foot of a swimmer is displaced from a position which is normally in the plane of the body into a position where the foot is located at a position below the plane of the body and the legs are pivoted above the hip socket to move the leg, foot and swim fin affixed to the foot through a predetermined angle. For purposes of this description, a "power stroke" refers to that portion of a swimmer's movement wherein the foot and fin is moved from a position which is substantially planar to the position of the swimmer's body to a position where the foot and fin are moved to a point located below the swimmer's body and further into the water. The term "reset stroke" refers to that portion of the kicking action wherein the foot for a swimmer is moved from the position located at a point below the plane of the swimmer's body and in the water to a position wherein the foot and associated fin is moved to a point which is in a plane substantially parallel to the plane of the swimmer's body.

Figure 1:
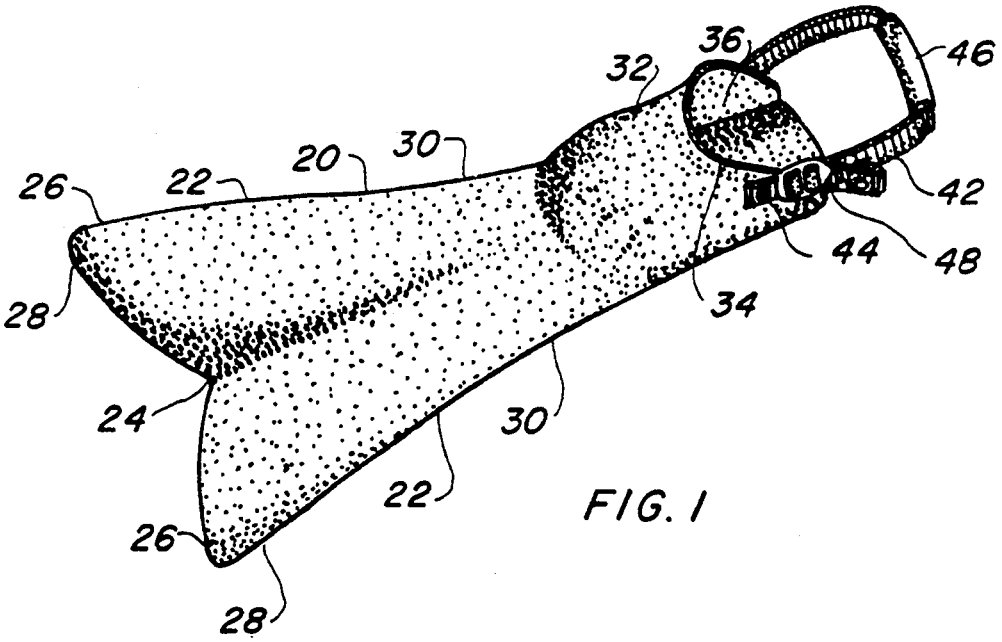
FIG. 1 is a partial isometric view of the preferred embodiment looking from the top.
Figure 2:
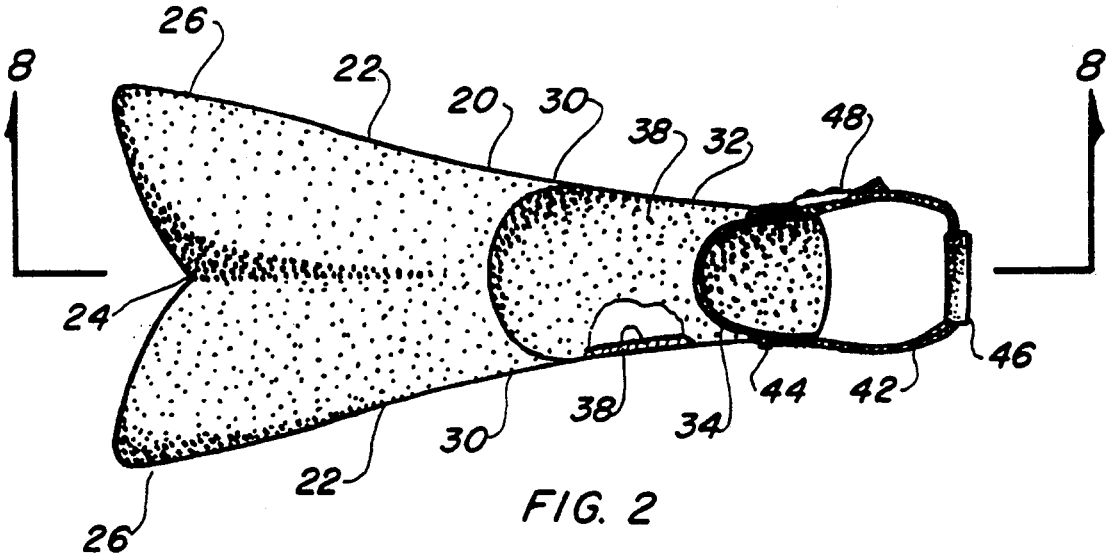
FIG. 2 is a top plan view of the preferred embodiment.
Figure 3:
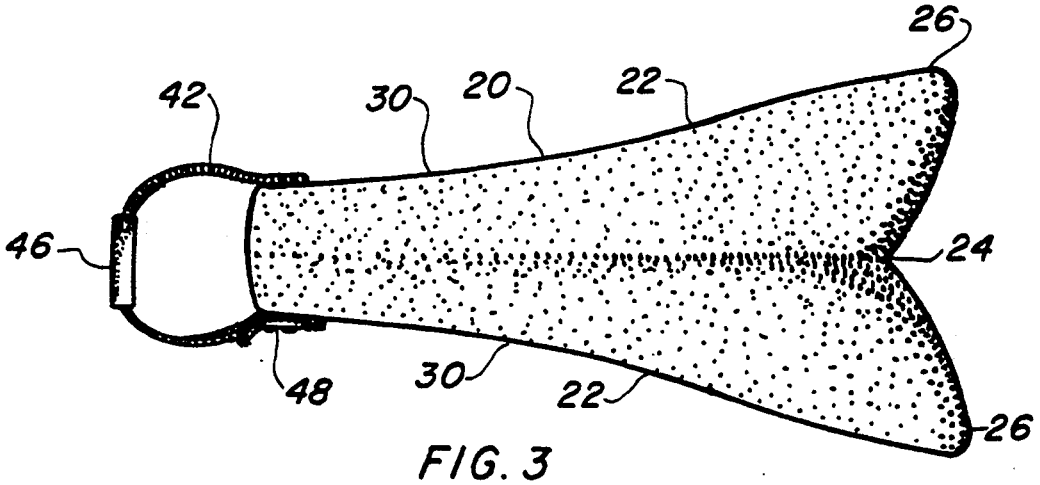
FIG. 3 is a bottom view of the preferred embodiment.
Figure 4:
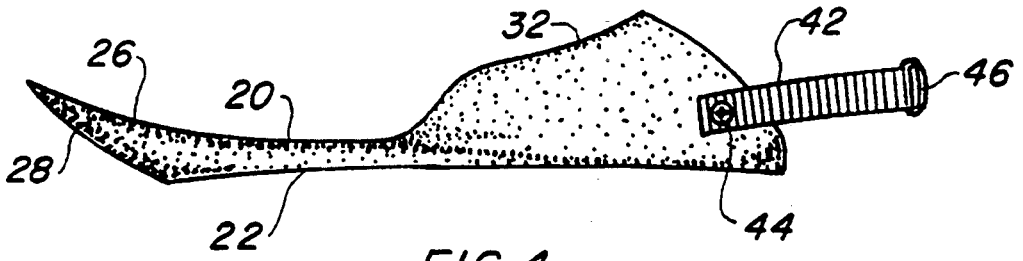
FIG. 4 is a right side elevation view of the preferred embodiment.
Figure 5:
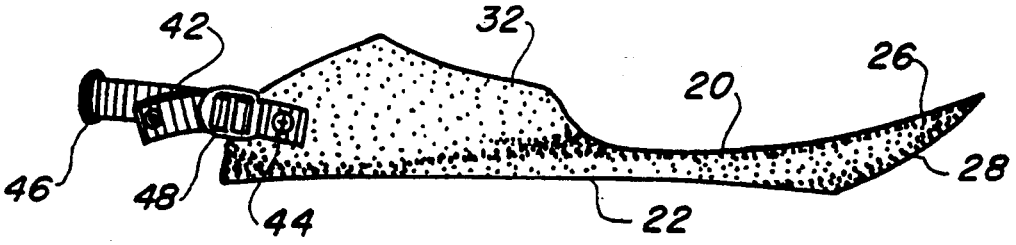
FIG. 5 is a left side elevation view of the preferred embodiment.
Figure 6:
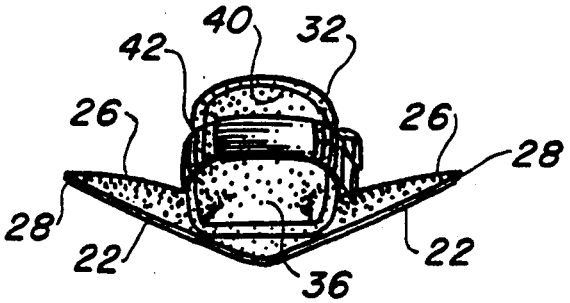
FIG. 6 is a rear view of the preferred embodiment.
Figure 7:
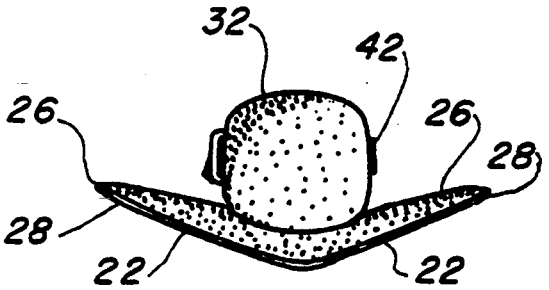
FIG. 7 is a front view of the preferred embodiment.
Figure 8:
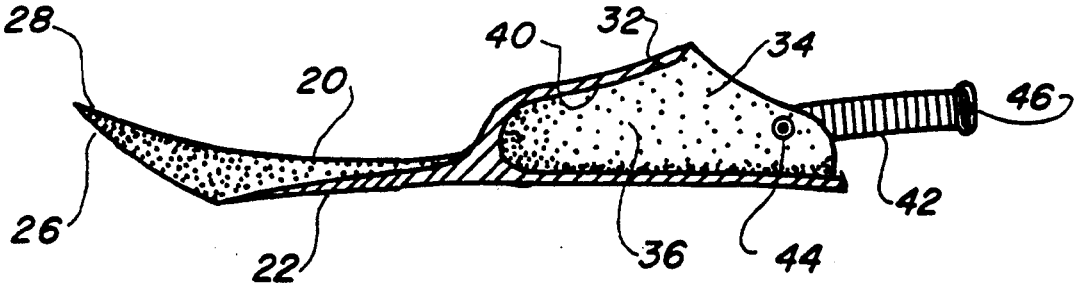
FIG. 8 is a cross-sectional view taken along lines 8—8 of FIG. 2.

The preferred embodiment, as shown in FIGS. 1 through 8, is comprised of a planar trapezoid shaped flexible base 20 with converging sides 22 and a centrally located inwardly converging contour 24 in a vee-shape forming tips 26 on either side. The base 20 is wider at the forward portion than the rearward portion, and the sides 22 are in an acute angular relationship. The tips 26 are turned upward 28, as illustrated in FIGS. 4, 5 and 8. The upward orientation is related to the normal usage, as attached to the swimmer's foot. The flexibility causes this shape to flatten only slightly when the fin is placed horizontal due to the effect of gravity. The drawings depict the fin as it would appear in the water with no force against it.

The length of the tips 26 are at least 25 percent of the length of the overall base 20 and the tips are disposed at an acute angle inward relative to the base center, as shown in FIGS. 2 and 3. This allows each tip 26 to have a compound angular relationship, both upward and inward from the balance of the base 20. The converging sides .22 of the base 20 are inwardly merging and have a radial contour 30.

An enlarged bulbous shoe like foot retainer 32 is formed integrally with the base 20 on the rearward narrowed portion having a rearward opening 34, the same approximate size as the swimmer's foot. The retainer 32 further contains an inside cavity 36 having a pair of outwardly tapered sides 38 and a top 40 larger in height than a swimmer's foot allowing flexing of the foot within the cavity 36.

The entire fin, including the base 20, tips 26 and foot retainer 32 is formed as an integral one-piece molding of resilient material, such as a polyurethane plastic. While this material is preferred, any other type of substance may be used with equal ease and functional capability.

In the preferred embodiment, the force developed during the power stroke by a swimmer results in the foot receiving portion of the fin being urged tightly against the foot of a swimmer such that the swimming fins will remain on the swimmer's feet without the need of fastening means. However, in order to provide additional security so that the fin will not fall off when the user is not swimming or so that contact with other objects will not pull the fin off of the swimmer, a strap 42 with fastening means 44 connected to the fin may be utilized to maintain the swim fin in engagement with the swimmer's foot.

This strap 42, shown in FIGS. 1 through 14, is therefore employed. The strap 42 is preferably made of a woven thermoplastic or cotton fiber and is attached to the foot retainers 32 by fastening means 44, such as riveting, screws, and nuts, etc., all well known in the art. Further, the strap 42 contains a stiffening sleeve 46 over the rear center portion to distribute the force evenly on the swimmer's heel. This sleeve is also made of a hollow thermoplastic material that is resilient, yet pliable enough to conform to the swimmer's heel. In order to make the strap 42 adjustable in length, a buckle 48 is employed, also well known in the art. This buckle 48 may be metal or plastic with a high grade of rigid thermoplastic being preferred, such as polyurethane, polyamide, phenolic polyester, reinforced polycarbonate, or the like.

The tips 26 of the base 20 have a movable end, which is deflectable when the swimmer applies force in one direction or the other. This end of the tip 26 is formed with a cross-section, varying in thickness from the sides tapered to a parallel center portion inbetween. The end of the tip 26 tapers similarly from the extreme forward point, allowing a predetermined flexibility and a streamlined shape for traversing through the water with a minimum of turbulance. The rearward portion of the base 20 is somewhat thicker, as illustrated in FIG. 8, which provides sufficient structural integrity to maintain a grip on the swimmer's foot and provide a structural base to support the foot retainer 32.

The tips 26 and forward and middle portion of the base 20 are flexible and deflect when forced by the water, as the cross-section is tapered on the outside edges. Further, the base 20 is parallel and relatively flat in the middle, and along with the tapered edges, permits a predetermined amount of flexibility which is optimum for the swimmer using the fins. The rearward portion of the base 20 is somewhat thicker than the parallel middle section, which provides sufficient strength to maintain a firm grip on the swimmer's foot.

The tips 26 of the base 20 are responsive to a hydraulic force urged against the upper surface of the fin permitting a flex of the tips through an arcuate shaped path curling away from the foot retainer 32 creating a build-up of water pressure within the lower surface, as it is responsive to a reaction force produced by the thicker cross-section of the rearward portion when the hydraulic force being urged against is discontinued immediately deflecting the tips 26, causing a snapping when the tips 26 abruptly reverse direction. The combination of flexing and snapping produce the desired propelling force as water is channeled through the inwardly diverging contour over and under the tapered edges of the flexible base 20. The snapping action is the novelty of the invention in combination with the bulbous foot retainer allowing the swimmer's foot to flex within the retainer 32. The snapping action of the tips 26 and middle portion of the base 20 is illustrated in a sequence in FIGS. 9 through 11.

Figure 9:
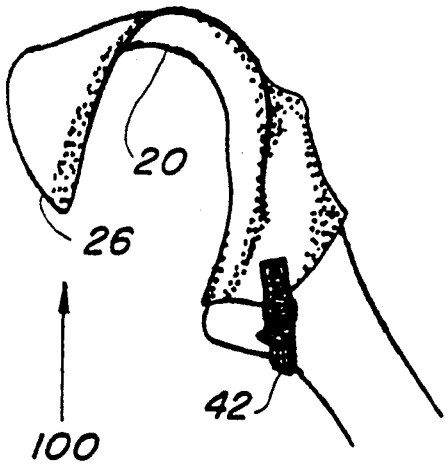
FIG. 9 is a pictorial representation of a swimmer's foot within the fin at the beginning of a power stroke.
Figure 12:
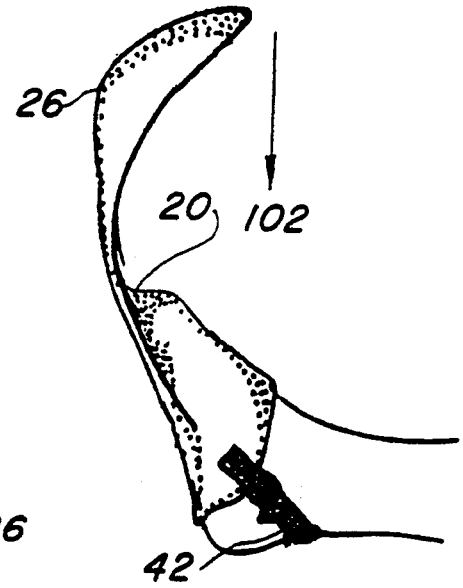
FIG. 12 is a pictorial representation of a swimmer's foot within the fin at the beginning of a reset stroke.
Figure 13:
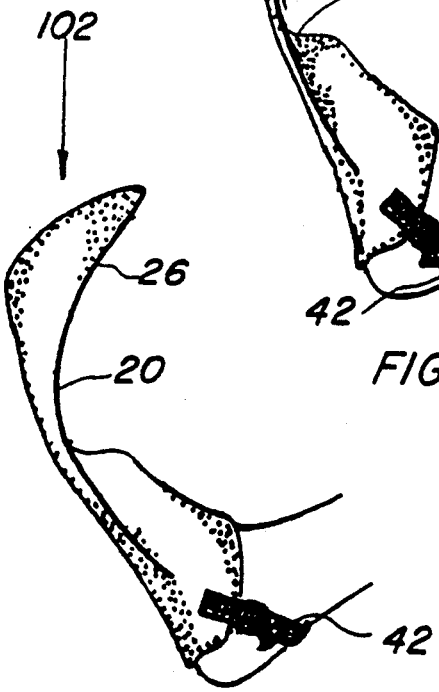
FIG. 13 is a pictorial representation of a swimmer's foot within the fin at the middle of a reset stroke.
Figure 10:
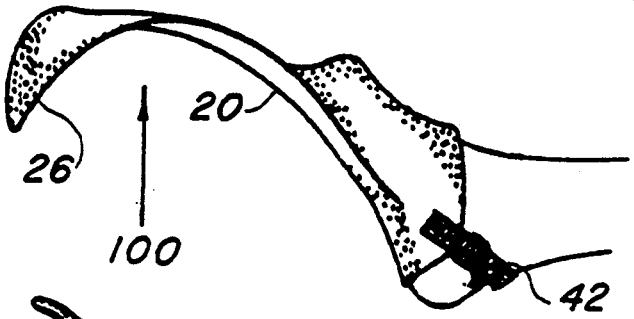
FIG. 10 is a pictorial representation of a swimmer's foot within the fin at the middle of a power stroke.
Figure 11:
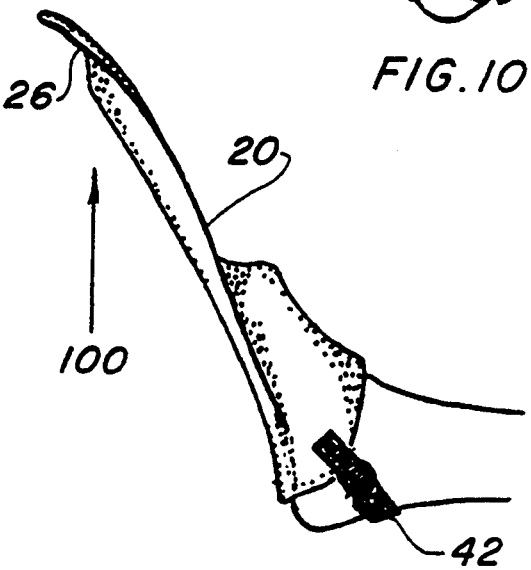
FIG. 11 is a pictorial representation of a swimmer's foot within the fin at the end of a power stroke.
Figure 14:
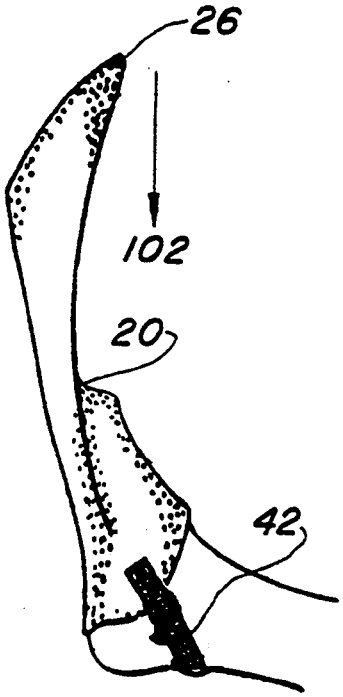
FIG. 14 is a pictorial representation of a swimmer's foot within the fin at the end of a reset stroke.

Further, FIGS. 12 through 14 depict the fins in the reset stroke relative to the force of the water completing the action produced by the swimmer during the propulsion cycle of the fin. FIGS. 9 through 11 illustrate the position of the fin at the beginning intermediate and bottom part of the power stroke, each viewed from the same position. The swimmer's foot is positioned within the retainer 32 and the foot is moved in a direction toward the toes, the upper surface of the base 20 is urged against the water which generates a force in the direction shown by arrow 100. The force 100 deflects the tips 26 away from the forward portion of the retainer 32 causing them to snap and deflect in a direction toward the base 20 at the rearward portion. As illustrated in FIG. 9, the foot of the swimmer is at a position midway during the power stroke and the force of the water illustrated by arrow 100 deflects the flexible fin such that the tips 26 are deflected along an arcuate path towards the rearward portion of the fin. The deflection of the fin base 20 combined with the snapping action of the upwardly extending movable tips 26 generate a propelling force which moves the swimmer through the water. FIG. 10 illustrates that the deflected end of the upwardly extending movable tips 26 have undergone a snapping action to generate the propulsion force and that the same are deflected toward the integral rearward portion of the base 20.

FIG. 11 illustrates the foot of a swimmer at the end of a power stroke. The force generated by the water, illustrated by arrow 100, is urged against the upper surface of the fin which urges the body 20 such that the tips are located at a distance which is spaced from and substantially parallel to the rearward portion of the base 20.

In conclusion, the propelling force is generated by the deflection of the tips 26 against the water force illustrated by arrow 100 and the snapping action of the tips 26 to propel the swimmer ahead.

FIGS. 12 through 14 illustrated the "reset stroke" with the foot of the swimmer located at the beginning, center and end of the reset stroke, respectively.

FIG. 12 illustrates that as the foot of the swimmer is moved in a direction toward the heel that the force of the water represented by arrow 102 is urged against the lower surface of the base which urges the tips 26 toward the swimmer's toes and causes the tips 26 to be deflected toward each other which has the effect of reducing the total surface of the base 20 which is in contact with and reacts with the water.

FIG. 13 illustrates that as the foot of the swimmer is moved into its intermediate position the tips 26 are urged along an arcuate shaped path toward the swimmer's toes and the forward portion of the retainer 32 by the force of the water illustrated by arrow 102.

FIG. 14 illustrates the position of the foot of a swimmer at the end of the reset stroke wherein the force generated by the water illustrated by the arrow 102 has caused the tips 26 to be deflected forward approximately 45 degrees forming an arcuate shaped cup member which retains a substantial volume of water and which generates a slightly negative pressure on the inner surface due to the fact that the water is moving across and spills across the lower surface of the base 20 along with the tips 26.

At the end of the reset stroke, the swimmer abruptly reverses the direction of foot movement which results in an abrupt reversal of the force generated by the water being reversed from the lower surface to the upper surface of the base 20. When the swimmer reverses the stroke, the tips 26 are deflected from a substantially forward position illustrated in FIG. 9 which switch in condition occurs abruptly. As the tips 26 are deflected from their forward position illustrated in FIG. 12 to its rearward position illustrated in FIG. 14 the tips 26 are moved in an arcuate shaped path which causes a "snapping action". The combination of the deflection of the base 20 and the "snapping action" of the movable fins 26 produces the propelling motion as previously discussed.

While the invention has been described in complete detail and pictorially shown in the accompanying drawings, it is not to be limited to such details, since many changes and modifications may be made in the invention without departing from the spirit and the scope thereof. Hence, it is described to cover any and all modifications and forms which may come within the language and scope of the appended claims.

I claim:

1. A closed shoe swim fin for assisting to propel a swimmer through the water comprising:

a planar trapezoid shaped flexible base having a forward portion, a rearward portion and a pair of converging sides, said forward portion further having a centrally located vee-shaped inwardly converging contour defining a pair of tips distal from the rearward portion in a symmetrical orientation with the forward portion wider than the rearward portion and the sides having an equal acute angular relationship and an inwardly merging radial contour, an enlarged bulbous shoe like foot retainer integral with the rearward portion of said base, the retainer having a rearward opening adaptable to receive a swimmer's foot and said retainer having an inside cavity of a volumetric proportion allowing a swimmer's foot to flex therewithin, whereby muscles of said swimmer's foot inserted within said bulbous shoe like foot retainer are allowed to move said foot and to provide additional strength to assist the leg of said foot in kick and flip movements of the fin, said tips of the base each having a movable end which are deflectable, further, said tips having a cross-sectional shape varying in thickness from the sides in a tapered manner to a parallel portion in between, and in like manner from the extreme forward portion allowing flexibility in a pre-determined manner with said rearward portion somewhat thicker than the parallel base between the sides providing sufficient structural integrity to maintain a grip in the wearers foot, and, said tips of the base being responsive to a force urged against an upper surface thereof to flex the tips through an arcuate shaped path curling away from the forward opening of the foot retainer creating a build-up of water pressure within a flexed lower surface, also being responsive to a reaction force produced by the thicker cross-section of the rearward portion when the force being urged against is discontinued immediately deflecting the tips causing a snapping action wherein the tips abruptly reverse direction with the combination of flexing and snapping producing a propelling force, as water is channeled through the inwardly diverging contour over and under the tapered edges of the flexible base.

2. The swim fin as recited in claim 1 wherein said inside cavity of said foot retainer further comprising a pair of outwardly tapered sides and a top larger in height than a swimmer's foot allowing flexing therewithin.

3. The swim fin as recited in claim 1 wherein said tips are turned upward on the forward portion relative to the base forward portion from an angle of 20 degrees to 25 degrees.

4. The swim fin as recited in claim 1 wherein the flexible base is slightly curved downward relative to the users foot starting just beyond a position where the users toes are in contact with the inside cavity of the bulbous foot retainer in a normal engaging manner.

5. The swim fin as recited in claim 1 wherein the length of the tips of the base are at least 25 percent of the length of the overall base and the tips are disposed at an arcuate angle inward relative to the base center for providing resistance on a power stroke thus limiting resistance when collapsing towards an upper surface of the fin on a reset stroke.

6. The swim fin as recited in claim 1 further comprising an adjustable strap attached to the foot retainer at each side of the rearward opening in a looping manner extending around the swimmer's heel holding the swimmer's foot securely within the retainer while in use, also allowing the strap to be shortened or lengthened to accommodate the size of the swimmer's foot.

7. The swim fin as recited in claim 1 wherein the entire fin is formed as an integral one-piece molding of resilient material.

8. The swim fin as recited in claim 7 wherein said resilient material further comprises a polyurethane thermoplastic.

* * * * *